US009919718B2

(12) United States Patent
Yan et al.

(10) Patent No.: US 9,919,718 B2
(45) **Date of Patent: *Mar. 20, 2018**

(54) VARIABLE STIFFNESS POSITIONING DEVICE FOR RAILWAY VEHICLE BOGIE AXLE BOX

(71) Applicant: CRRC Yangtze Corporation Limited, Wuhan (CN)

(72) Inventors: Zhixiong Yan, Wuhan (CN); Ruijin Jiang, Wuhan (CN); Liangwei Zhang, Wuhan (CN); Hong Cui, Wuhan (CN); Fengwei Liu, Wuhan (CN); Wenliang Liu, Wuhan (CN); Tiejun Fu, Wuhan (CN); Zhaojun Dan, Wuhan (CN); Pingping Wang, Wuhan (CN)

(73) Assignee: CRRC Yangtze Corporation Limited, Wuhan HB (CN)

( * ) Notice: Subject to any disclaimer, the term of this patent is extended or adjusted under 35 U.S.C. 154(b) by 231 days.

This patent is subject to a terminal disclaimer.

(21) Appl. No.: 14/784,932

(22) PCT Filed: Oct. 31, 2014

(86) PCT No.: PCT/CN2014/090008

§ 371 (c)(1),
(2) Date: Oct. 15, 2015

(87) PCT Pub. No.: WO2015/101095

PCT Pub. Date: Jul. 9, 2015

(65) Prior Publication Data

US 2017/0129509 A1 May 11, 2017

(30) Foreign Application Priority Data

Dec. 30, 2013 (CN) ..... 2013 1 0746907
Dec. 30, 2013 (CN) ..... 2013 2 0884852 U

(51) Int. Cl.
*B61F 5/30* (2006.01)
*B61F 5/36* (2006.01)

(52) U.S. Cl.
CPC ..... *B61F 5/305* (2013.01); *B61F 5/30* (2013.01); *B61F 5/301* (2013.01); *B61F 5/36* (2013.01)

(58) Field of Classification Search
CPC .. B61F 5/30; B61F 5/301; B61F 5/305; B61F 5/308; B61F 5/36
(Continued)

(56) References Cited

U.S. PATENT DOCUMENTS 2,207,848 A * 7/1940 Barrows ..... B61F 5/305 105/224.1
2,229,429 A * 1/1941 Travilla, Jr. ..... B61F 5/305 105/222
(Continued)

FOREIGN PATENT DOCUMENTS

CN 101011971 8/2007
CN 102001345 4/2011
(Continued)

OTHER PUBLICATIONS

International Search Report issued in PCT/CN2014/090008 dated Dec. 19, 2014.

*Primary Examiner* — Zachary L Kuhfuss
(74) *Attorney, Agent, or Firm* — Kolisch Hartwell, P.C.

(57) ABSTRACT

The present invention provides a variable stiffness positioning device for a railway vehicle bogie axle box. The variable stiffness positioning device includes a vertical elastomer arranged between the top face of an axle box bearing saddle and the bottom surface of a guide frame of a side fame, and a longitudinal elastomer arranged between the axle box bearing saddle and the front and back side faces of the guide frame of the side fame, the longitudinal elastomer is provided with at least one small-stiffness elastic element and a large-stiffness elastic element, and the small-stiffness elastic element is arranged in an elastomer pre-compression device and is serially arranged with the large-stiffness elastic element under the action of a pre-compression load F1. The longitudinal elastomer has a larger longitudinal compression stiffness when the longitudinal deformation displacement is very small, so that the railway vehicle can be guaranteed to have a higher snaking critical operation speed when operating on a straight line, and the acceleration operation
(Continued)

demand of the vehicle is satisfied; when the longitudinal deformation displacement reaches a set numerical value, the longitudinal compression stiffness of the longitudinal elastomer starts to become small, so that when the railway vehicle passes by a curve, it can be guaranteed that the lateral force between wheel rails will not be too large, and thus the curve operation safety of the vehicle is guaranteed.

10 Claims, 4 Drawing Sheets

(58) Field of Classification Search
USPC ..... 105/224.05, 224.1
See application file for complete search history.

(56) References Cited

U.S. PATENT DOCUMENTS 2,474,008 A * 6/1949 Meyer ..... B61F 5/305 105/225
2,802,662 A * 8/1957 Hirst ..... B60G 11/22 105/224.05
2,836,130 A * 5/1958 Rossell ..... B61F 5/305 105/190.1
3,274,955 A * 9/1966 Thomas ..... B61F 5/305 105/224.1
3,920,231 A * 11/1975 Harrison ..... F16F 13/08 105/224.1
4,026,217 A * 5/1977 Cross ..... B60B 17/00 105/224.1
4,416,203 A * 11/1983 Sherrick ..... B61F 5/305 105/224.1

FOREIGN PATENT DOCUMENTS

CN 102001345 6/2011
CN 103112466 5/2012
CN 103693063 4/2014
CN 1036933063 4/2014
CN 203793353 8/2014
FR 2279578 2/1976
FR 2279578 A1 * 2/1976 ..... B60G 15/04
FR 2279578 3/1976
UA 82338 4/2008

* cited by examiner

VARIABLE STIFFNESS POSITIONING DEVICE FOR RAILWAY VEHICLE BOGIE AXLE BOX

FIELD OF THE INVENTION

The present invention relates to the design and manufacture technology of railway vehicle bogies, and particularly, to a variable stiffness positioning device of a railway vehicle bogie axle box.

BACKGROUND OF THE INVENTION

A railway vehicle is a special vehicle operating on special rails, and when operating along the special rails, the railway vehicle can be self-oriented without being controlled in direction. A bogie is one of the most important components on the railway vehicle, and it supports the weight of an entire commodity and the weight of the vehicle body. The traditional bogies is mostly of a structure with three large parts, namely, two side frame components and a swing bolster component, guide frames on both ends of the side frame components are installed on front and back wheel pair components through axle box bearing saddles and bearing devices, and both ends of the swing bolster component are installed in central square frames of the side frame components through two groups of central suspension devices. The axle box bearing saddles and the bearing devices are movable joints contacting the side frame components with the wheel pair components, are used for converting rolling of wheels along the rail route into translation of the vehicle body along the rail route, and can flexibly operate along a straight line and successfully pass by a curve.

When the railway vehicle operates at a high speed on the rails, complex impact and vibration will be produced accordingly. A traditional axle box bearing saddle and the guide frames on both ends of the side frame component adopt a rigid connection structure, which has the defects that the axle box bearing saddle and the guide frames of the side frame are rigidly positioned in a dry friction manner, the frictional force increases linearly to fail to adapt to the high-speed operation demand of the vehicle, moreover the lateral force of wheel rails is large, and thus the risk of train derailment is increased. In order to reduce a variety of dynamic effects of unsmooth rail routes and high speed motion of wheel pairs on the vehicle body, for example, longitudinal impact, vertical vibration, lateral vibration and the like, those skilled in the art often additionally set an elastic device between the guide frame of the side frame and the wheel pair component of the railway vehicle bogie, and the elastic device is generally called an elastic axle box suspension device. The elastic axle box suspension device plays an important role in such aspects as whether the linear operation of the vehicle is stable, whether the vehicle can successfully pass by the curve, and guaranteeing the safe operation of the vehicle, and the like.

With the continuous increase of the load capacity of the railway vehicle, the axle weight of the vehicle increases constantly, and the operation speed of the vehicle is continuously improved, so that the requirements on the quality and performance of the vehicle bogie is also higher and higher. At a state of heavy load and high speed, when moving along the rails, the vehicle wheel pairs are easier to initiate yaw motion of the vehicle body, resulting in greatly reduced operation quality of the vehicle and will cause a vehicle derailment accident seriously. Meanwhile, when the vehicle passes by the curve, the lateral force of the wheel rail cannot be too large, otherwise, the vehicle is also possible to derail. One of the critical components directly affecting the snaking critical operation speed of the railway vehicle on a straight line and the passing performance of the vehicle on a curve is the elastic axle box suspension device, and the structural shape design and the elastic stiffness parameter design thereof are of vital importance. In order to increase the snaking critical operation speed of the railway vehicle on the straight line, larger longitudinal positioning stiffness of the elastic axle box suspension device must be required; when the vehicle passes by the curve, to prevent an over large lateral force of the wheel rail, a smaller longitudinal positioning stiffness of the elastic axle box suspension device must be required.

At present, improving the snaking critical operation speed of the vehicle on the straight line and improving the passing performance of the vehicle on the curve are a pair of contradictions, and thus it is very hard to give consideration to both in the specific design of the elastic axle box suspension device of the vehicle bogie. This is because, two main elastic axle box suspension devices cannot simultaneously satisfy the above-mentioned requirements at present: one is a vertical elastic device arranged between the top face of the axle box bearing saddle and the bottom surface of the guide frame of the side frame, although the device has a certain function on vertical damping of the bogie, the axle box bearing saddle is in rigid hard contact with the bottom surface of the guide frame of the side frame, and no buffering device is available, so that the inhibitory effect on lateral vibration and longitudinal vibration of the bogie is poor, moreover the structural design is quite complex, the parameter matching difficulty is very large, the assembly universality is poor, and the snaking critical operation speed of the vehicle on the straight line and the passing performance requirement of the vehicle on the curve cannot be compromised in the case of acceleration and heavy load. Another condition is that a vertical elastic device is arranged, and longitudinal elastic devices are arranged between the axle box bearing saddle and both sides of the guide frame of the side frame, in this way, damping and control on the longitudinal impact of the bogie are easier to achieve, but the stiffness of the front and back longitudinal elastic devices are invariable, due to the limitation of this structural form, with the increase of the displacement, the load of the bogie increases linearly or in an equal proportional increase manner, the snaking critical operation speed of the vehicle on the straight line and the passing performance requirement of the vehicle on the curve cannot be completely compromised either, and meanwhile the risk of train derailment also exists, so that the functions of the elastic axle box suspension device are greatly reduced.

How to effectively improve the linear stability and the curve passing performance of the heavy-loaded vehicle operates at a high speed is always a problem attempted to be solved by those skilled in the art, and this has important practical significance of improving the operation quality of the railway vehicle and guaranteeing the safety performance of the railway vehicle.

SUMMARY OF THE INVENTION

The purpose of the present invention is to reform the defects of the existing elastic axle box suspension device and provide a variable stiffness positioning device for a railway vehicle bogie axle box, which can give consideration to both a linear snaking critical operation speed of a vehicle and a curve passing performance requirement of the vehicle. To fulfill the above-mentioned purpose, the variable stiffness positioning device for the railway vehicle bogie axle box designed in the present invention is installed between an axle box bearing saddle of a vehicle bogie and a guide frame of a side frame of the vehicle bogie, and the special features lie in that the variable stiffness positioning device includes a vertical elastomer arranged between the top face of the axle box bearing saddle and the bottom surface of the guide frame of the side fame, as well as longitudinal elastomers respectively arranged between the axle box bearing saddle and the front and back side faces of the guide frame of the side fame.

The longitudinal elastomer is provided with at least one small-stiffness elastic element and a large-stiffness elastic element, the small-stiffness elastic element is arranged in an elastomer pre-compression device and is serially arranged with the large-stiffness elastic element under the action of a pre-compression load F1.

In a process of becoming from small to large of a working load F2, the longitudinal elastomer satisfies the following relationship: when F2 is smaller than F1, the large-stiffness elastic element is compressed to deform at first; when F2 is equal to F1, the large-stiffness elastic element and the pre-compressed small-stiffness elastic element are at a critical state; until when F2 is larger than F1, the small-stiffness elastic element starts to be continuously compressed to deform, so that the longitudinal elastomer has a two-stage variable stiffness property being hard at first and then becoming soft at the load state.

As a first preferable solution the large-stiffness elastic element is provided with an elastic rubber base layer, and the elastic rubber base layer is clamped between two metal bearing plates and is vulcanized into an entirety with the same.

The elastomer pre-compression device is provided with a rigid outer cover, an oriented positioning screw is axially arranged in the rigid outer cover, one end of the oriented positioning screw stretches out from the opening of the rigid outer cover to be fixedly connected with one of the two metal bearing plates, and the other end of the oriented positioning screw stretches out from the bottom surface of the rigid outer cover to form threaded connection with a locking nut.

The small-stiffness elastic element adopts one of the following three structures: first, the small-stiffness elastic element is provided with a conical cylindrical rubber layer, the conical cylindrical rubber layer is arranged between the inner wall of the rigid outer cover and the oriented positioning screw and is vulcanized into an entirety with the same, and the conical cylindrical rubber layer is at a pre-compression state under the tightening function of the locking nut.

Second, the small-stiffness elastic element is provided with a cylindrical overlapped rubber layer integrally vulcanization molded by multiple layers of sheet metals and multiple layers of sheet rubber, which are arranged in a staggered manner, the cylindrical overlapped rubber layer is sleeved on the oriented positioning screw, one end of the cylindrical overlapped rubber layer is propped against one of the two metal bearing plates, the other end of the cylindrical overlapped rubber layer is propped against the bottom surface of the rigid outer cover, and the cylindrical overlapped rubber layer is at a pre-compression state under the tightening function of the locking nut.

Third, the small-stiffness elastic element is provided with a metal helical spring, the metal helical spring is sleeved on the oriented positioning screw, one end of the metal helical spring is propped against one of the two metal bearing plates, the other end of the metal helical spring is propped against the bottom surface of the rigid outer cover, and the metal helical spring is at a pre-compression state under the tightening function of the locking nut.

The commonality of the above three structures is that the large-stiffness elastic element and the oriented positioning screw are integrally designed and apply the pre-compression load F1 to the small-stiffness elastic element together.

As a second preferable solution:

the large-stiffness elastic element is provided with an elastic rubber base layer, and the elastic rubber base layer is clamped between two metal bearing plates and is vulcanized into an entirety with the same.

The elastomer pre-compression device is provided with a rigid outer cover, an oriented positioning screw is axially arranged in the rigid outer cover, one end of the oriented positioning screw stretches out from the opening of the rigid outer cover to be fixedly connected with an end face baffle, the other end of the oriented positioning screw stretches out from the bottom surface of the rigid outer cover to form threaded connection with a locking nut, the end face baffle is propped against one of the two metal bearing plates, and a positioning lug boss is arranged on the end face of the other metal bearing plate.

The small-stiffness elastic element is provided with a metal helical spring, the metal helical spring is sleeved on the oriented positioning screw, one end of the metal helical spring is propped against the end face baffle, the other end of the metal helical spring is propped against the bottom surface of the rigid outer cover, and the metal helical spring is at a pre-compression state under the tightening function of the locking nut.

The property of this structure lies in that the large-stiffness elastic element and the oriented positioning screw are separately designed, and the pre-compression load F1 is applied on the small-stiffness elastic element through the end face baffle.

Further, the rigid outer cover of the elastomer pre-compression device is detachably embedded into a side face mounting hole of the guide frame of the side frame, and the other metal bearing plate of the large-stiffness elastic element is propped or hanged on the side face of the axle box bearing saddle. In this way, the longitudinal elastomer is designed to be of a detachable structure, thereby being very convenient to assemble, maintain and change.

As a third preferable solution the vertical elastomer includes an inner metal supporting sleeve with a conical surface outer wall and an outer metal supporting sleeve with a conical surface inner wall, a trumpet-shaped rubber sleeve vulcanized into an entirety with the inner metal supporting sleeve and the outer metal supporting sleeve is arranged there between, so that the vertical elastomer is of a conical platform-shaped structure on the whole. In this way, the vertical elastomer is not only simple in structure, strong in universality and convenient to disassemble, assemble and overhaul, and the trumpet-shaped rubber sleeve therefore forms a certain included angle with the vertical plane to effectively play the advantages of shear elasticity and compression combination and enable an axle box to obtain larger vertical deflection and proper longitudinal and horizontal stiffness.

Further, a cylindrical surface extension segment is smoothly arranged at the upper part of the conical surface inner wall of the outer metal supporting sleeve, the cylindrical surface extension segment is in vulcanization connection with the upper part of the outer wall of the trumpet-shaped rubber sleeve, and the upper and lower ends of the trumpet-shaped rubber sleeve are of concave curve surface structures. In this way, smooth, stable and reliable connection of the inner and outer walls of the trumpet-shaped rubber sleeve with the inner metal supporting sleeve and the outer metal supporting sleeve can be guaranteed, the bearing load is uniformly distributed and the service life thereof is effectively prolonged. Further, the trumpet-shaped rubber sleeve is integrally vulcanization molded by multiple layers of trumpet-shaped metal rings and multiple layers of trumpet-shaped rubber rings which are arranged in a staggered manner, and the included angles α between the generatrixes of the trumpet-shaped metal rings and the trumpet-shaped rubber rings with the conical surface inner wall of the outer metal supporting sleeve are 15-88 degrees. In this way, the combination number of the trumpet-shaped metal rings and the trumpet-shaped rubber rings can be adjusted according to demand and different included angles α can be designed to enable the vertical elastomer to satisfy the requirements of different elasticity and stiffness of the axle box and fully play the buffering and damping functions of the vertical elastomer. Further, the upper end of the outer metal supporting sleeve is embedded into a bottom surface mounting hole of the guide frame of the side frame, and the lower end of the inner metal supporting sleeve is embedded into a top face mounting hole of the axle box bearing saddle. In this way, the vertical elastomer is designed to be of a detachable structure, thereby being very convenient to assemble, maintain and change.

The main working principle of the present invention is as follows: the designed longitudinal elastomer is composed of the small-stiffness elastic element and the large-stiffness elastic element, which are installed in the elastomer pre-compression device in a compression manner and are combined in series. When the longitudinal elastomer bears a load, since the initial load is smaller than the set pre-compression load of the small-stiffness elastic element, the large-stiffness elastic element bears the load at first; with the gradual increase of the load, the deformation displacement of the longitudinal elastomer will increase slowly; but once the load is larger than the set pre-compression load of the small-stiffness elastic element, the small-stiffness elastic element starts to bear the load, and since the stiffness thereof is small, the deformation displacement of the small-stiffness elastic element will increase quickly after bearing the load, so as to achieve the two-stage variable stiffness property being soft at first and then becoming hard of the longitudinal elastomer.

The present invention has the following advantages: the designed longitudinal elastomer has larger longitudinal compression stiffness when the longitudinal deformation displacement is very small, so that the railway vehicle can be guaranteed to have a higher snaking critical operation speed when operating on a straight line, and the acceleration operation demand of the vehicle is satisfied; when the longitudinal deformation displacement reaches a set numerical value, the longitudinal compression stiffness of the longitudinal elastomer starts to become small, so that when the railway vehicle passes by a curve, it can be guaranteed that the lateral force between wheel rails will not be too large to guarantee the curve operation safety of the vehicle, and thus the contradiction that the linear snaking critical operation speed of the vehicle and the curve passing performance of the vehicle cannot be compromised is effectively solved. Meanwhile, the designed vertical elastomer can both enable the axle box to obtain better vertical deflection and enable the axle box to obtain better lateral stiffness, and the vertical elastomer can also cooperate with the longitudinal elastomers on both sides to smoothly and stably achieve the two-stage variable stiffness property being soft at first and then becoming hard of the longitudinal elastomer, so as to effectively reduce the unsprung mass of the bogie, buffer the wheel rail impact of the vehicle, improve the dynamic performance of the vehicle and guarantee the operation safety of the vehicle to greatly perfect the operation quality of the railway vehicle.

Figure 1:
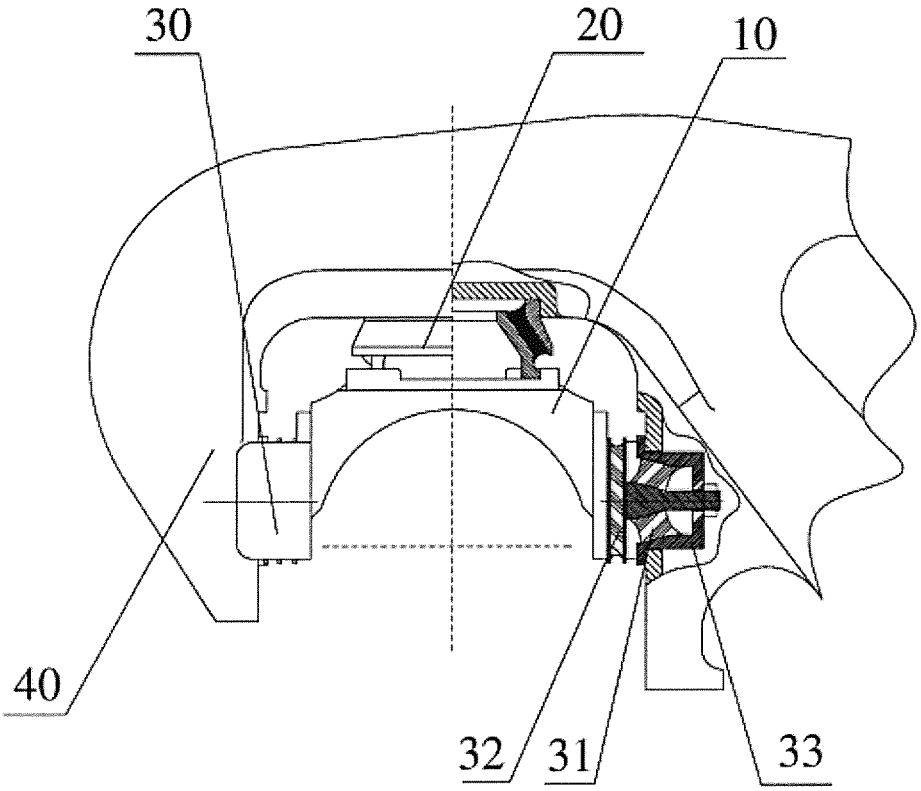
FIG. 1 is a schematic diagram of a main sectional structure of a variable stiffness positioning device for a railway vehicle bogie axle box.

Mark numbers of the components in the figures are as follows: axle box bearing saddle 10; vertical elastomer 20 (wherein: inner metal supporting sleeve 21, trumpet-shaped rubber sleeve 22, concave curve surface structure 22*a*, trumpet-shaped metal ring 22*b*, trumpet-shaped rubber ring 22*c*, outer metal supporting sleeve 23, cylindrical surface extension segment 23*a*); longitudinal elastomer 30 (wherein: small-stiffness elastic element 31, conical cylindrical rubber layer 31*a*, cylindrical overlapped rubber layer 31*b*, metal helical spring 31*c*, large-stiffness elastic element 32, elastic rubber base layer 32*a*, metal bearing plate 32*b*, elastomer pre-compression device 33, rigid outer cover 33*a*, oriented positioning screw 33*b*, locking nut 33*c*, end face baffle 3*d*, positioning lug boss 34); guide frame 40 of side frame.

DETAILED DESCRIPTION OF THE EMBODIMENTS

To better explain the present invention, the main contents of the present invention will be further illustrated below in combination with the accompanying drawings and specific embodiments, but the contents of the present invention are not merely limited to the following embodiments.

As shown in FIG. 1, a variable stiffness positioning device for a railway vehicle bogie axle box provided by the present invention is mainly composed of a vertical elastomer 20 arranged between the top face of an axle box bearing saddle 10 and the bottom surface of a guide frame 40 of a side fame, and longitudinal elastomers 30 respectively arranged between the axle box bearing saddle 10 and the front and back side faces of the guide frame 40 of the side fame. The longitudinal elastomer 30 is provided with a small-stiffness elastic element 31 and a large-stiffness elastic element 32, and the small-stiffness elastic element 31 is arranged in an elastomer pre-compression device 33 and is serially arranged with the large-stiffness elastic element 32 under the action of a pre-compression load F1.

Figure 2:
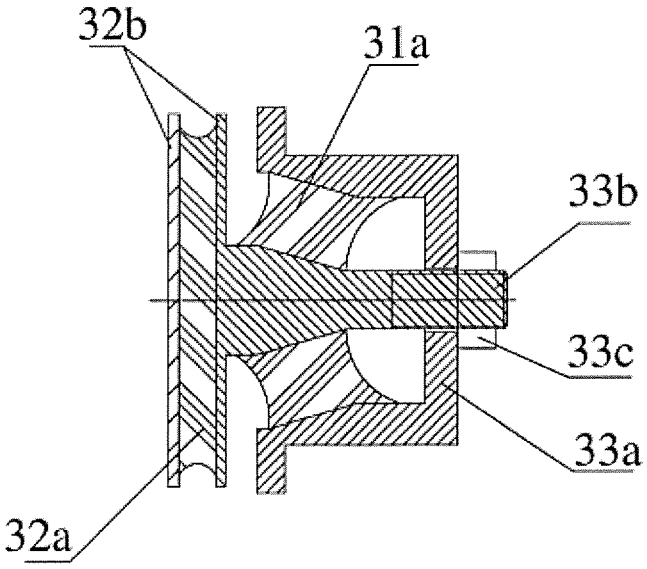
FIG. 2 is a schematic diagram of an amplified sectional structure of a first longitudinal elastomer in FIG. 1.
Figure 3:
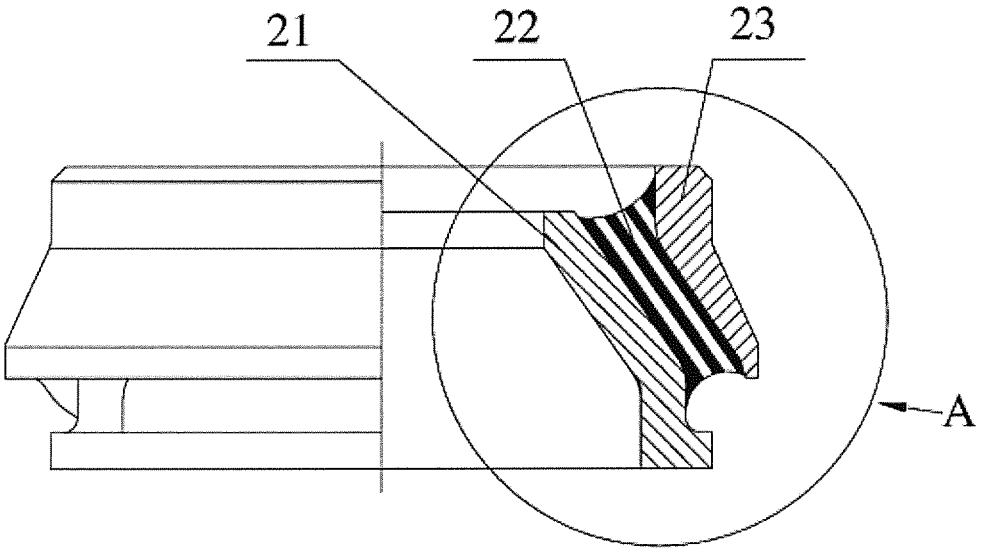
FIG. 3 is a schematic diagram of an amplified sectional structure of a vertical elastomer in FIG. 1.

As shown in FIG. 2, the large-stiffness elastic element 32 is provided with an elastic rubber base layer 32*a*, and the elastic rubber base layer 32*a* is clamped between two metal bearing plates 32*b* and is vulcanized into an entirety with the same. The elastomer pre-compression device 33 is provided with a rigid outer cover 33*a*, an oriented positioning screw 33*b* is axially arranged in the rigid outer cover 33*a*, one end of the oriented positioning screw 33*b* stretches out from the opening of the rigid outer cover 33*a* to be fixedly connected with one metal bearing plate 32*b*, and the other end of the oriented positioning screw 33*b* stretches out from the bottom surface of the rigid outer cover 33*a* to form threaded connection with a locking nut 33*c*. The small-stiffness elastic element 31 is provided with a conical cylindrical rubber layer 31*a*, and the conical cylindrical rubber layer 31*a* is arranged between the inner wall of the rigid outer cover 33*a* and the oriented positioning screw 33*b* and is vulcanized into an entirety with the same. The conical cylindrical rubber layer 31*a* is at a pre-compression state under the action of the pre-compression load F1, after the locking nut 33*c* is tightened. Meanwhile, in a process of a working load F2 becoming from small to large, the longitudinal elastomer 30 satisfies the following relationship: when F2 is smaller than F1, the large-stiffness elastic element 32 is compressed to deform at first; when F2 is equal to F1, the large-stiffness elastic element 32 and the pre-compressed small-stiffness elastic element 31 are at a critical state; until when F2 is larger than F1, the small-stiffness elastic element 31 starts to be continuously compressed to deform, so that the longitudinal elastomer 30 has a two-stage variable stiffness property being hard at first and then becoming soft at the load state. As shown in FIG. 3, the vertical elastomer 20 includes an inner metal supporting sleeve 21 with a conical surface outer wall and an outer metal supporting sleeve 23 with a conical surface inner wall, a trumpet-shaped rubber sleeve 22 vulcanized into an entirety with the inner metal supporting sleeve 21 and the outer metal supporting sleeve 23 is arranged therebetween, so that the vertical elastomer 20 is of a conical platform-shaped structure on the whole.

Figure 4:
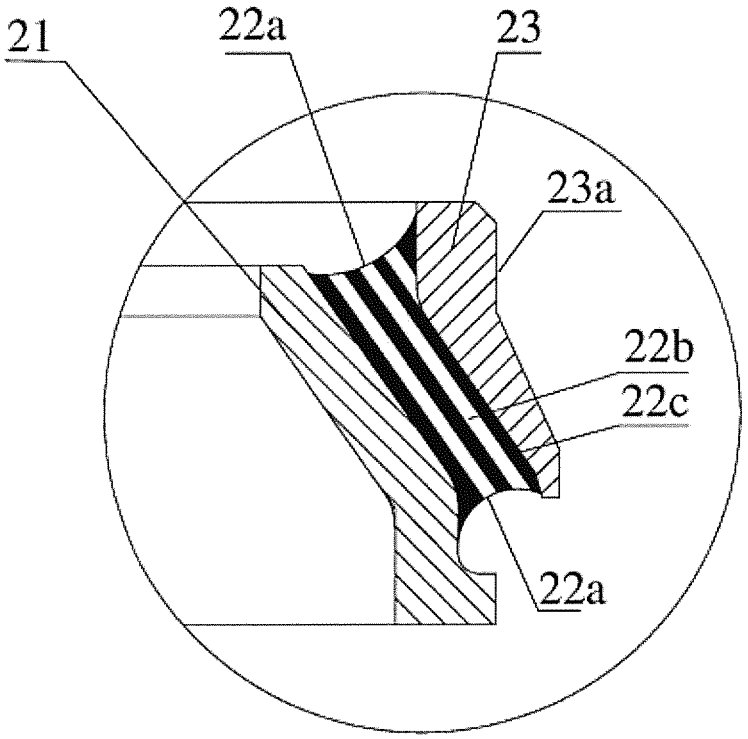
FIG. 4 is a schematic diagram of an amplified structure of an A part in FIG. 3.

As shown in FIG. 4, a cylindrical surface extension segment 23*a* is smoothly arranged at the upper part of the conical surface inner wall of the outer metal supporting sleeve 23, the cylindrical surface extension segment 23*a* is in vulcanization connection with the upper part of the outer wall of the trumpet-shaped rubber sleeve 22, and the upper and lower ends of the trumpet-shaped rubber sleeve 22 are of concave curve surface structures 22*a*. Meanwhile, the trumpet-shaped rubber sleeve 22 is integrally vulcanization molded by multiple layers of trumpet-shaped metal rings 22*b* and multiple layers of trumpet-shaped rubber rings 22*c* which are arranged in a staggered manner, and the included angles $\alpha$ between the generatrixes of the trumpet-shaped metal rings 22*b* and the trumpet-shaped rubber rings 22*c* with the conical surface inner wall of the outer metal supporting sleeve 23 are 35-65 degrees.

Still as shown in FIG. 1, when the positioning device provided by the present invention is assembled, the upper end of the outer metal supporting sleeve 23 of the vertical elastomer 20 is embedded into a bottom surface mounting hole of the guide frame 40 of the side frame, and the lower end of the inner metal supporting sleeve 21 is embedded into a top face mounting hole of the axle box bearing saddle 10. For the longitudinal elastomer 30, the rigid outer cover 33*a* of the elastomer pre-compression device 33 is detachably embedded into a side face mounting hole of the guide frame 40 of the side frame, and the other metal bearing plate 32*b* of the large-stiffness elastic element 32 is propped on the side face of the axle box bearing saddle 10 under the action of the small-stiffness elastic element 31.

Figure 5:
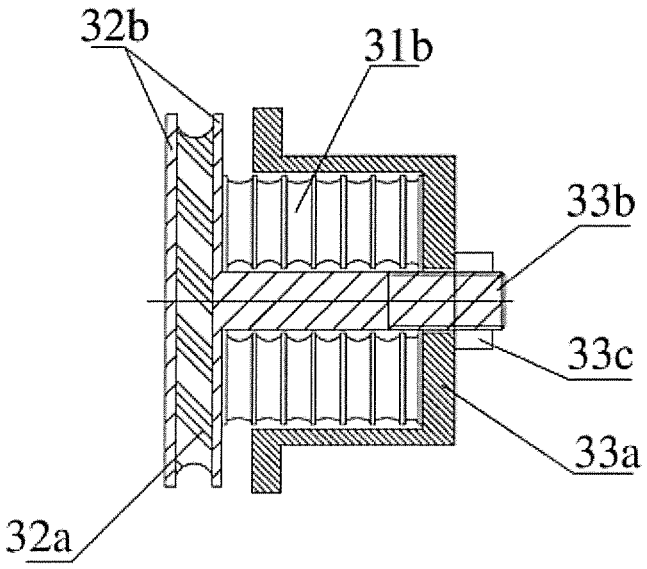
FIG. 5 is a schematic diagram of an amplified sectional structure of a second longitudinal elastomer in FIG. 1.
Figure 6:
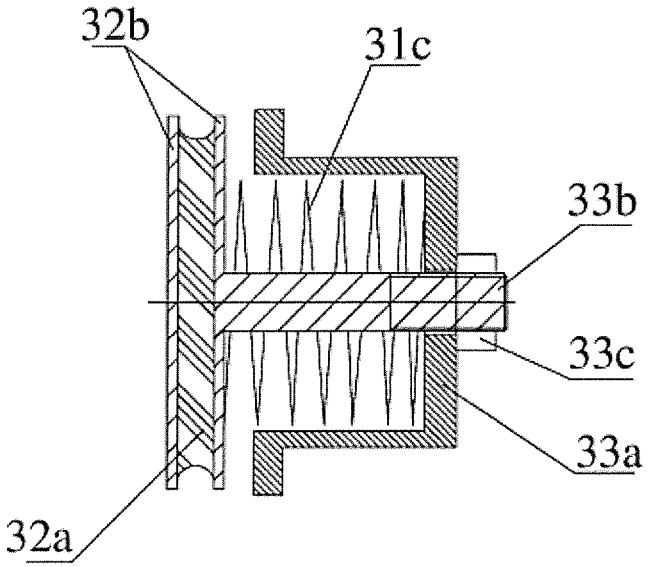
FIG. 6 is a schematic diagram of an amplified sectional structure of a third longitudinal elastomer in FIG. 1.

The first longitudinal elastomer 30 in FIG. 2 can also be replaced by other similar structures as shown in FIG. 5 and FIG. 6.

In the second longitudinal elastomer 30 as shown in FIG. 5, the structures of the large-stiffness elastic element 32 and the elastomer pre-compression device 33 are completely the same as those in the first longitudinal elastomer, and only the small-stiffness elastic element 31 is different. The small-stiffness elastic element 31 is provided with a cylindrical overlapped rubber layer 31*b* integrally vulcanization molded by multiple layers of sheet metals and multiple layers of sheet rubber, which are arranged in a staggered manner, the cylindrical overlapped rubber layer 31*b* is sleeved on the oriented positioning screw 33*b*, one end of the cylindrical overlapped rubber layer 31*b* is propped against one metal bearing plate 32*b*, and the other end of the cylindrical overlapped rubber layer 31*b* is propped against the bottom surface of the rigid outer cover 33*a*. The cylindrical overlapped rubber layer 31*b* is at a pre-compression state under the action of the pre-compression load F1, after the locking nut 33*c* is tightened.

In the third longitudinal elastomer 30 as shown in FIG. 6, the structures of the large-stiffness elastic element 32 and the elastomer pre-compression device 33 are completely the same as those in the first longitudinal elastomer, and only the small-stiffness elastic element 31 is different. The small-stiffness elastic element 31 is provided with a metal helical spring 31*c*, the metal helical spring 31*c* is sleeved on the oriented positioning screw 33*b*, one end of the metal helical spring 31*c* is propped against one metal bearing plate 32*b*, and the other end of the metal helical spring 31*c* is propped against the bottom surface of the rigid outer cover 33*a*. The metal helical spring 31*c* is at a pre-compression state under the action of the pre-compression load F1, after the locking nut 33*c* is tightened.

In an operation process of the variable stiffness positioning device for the railway vehicle bogie axle box provided by the present invention on a railway vehicle, when the longitudinal elastomer 30 bears a load, since the initial load is smaller than the pre-compression load F1 of the small-stiffness elastic element 31, the large-stiffness elastic element 32 bears the load at first. In this way, the longitudinal elastomer 30 has larger longitudinal compression stiffness when the longitudinal deformation displacement is very small, so that the railway vehicle can be guaranteed to have a higher snaking critical operation speed when operating on a straight line, and the acceleration operation demand of the vehicle is satisfied. With the gradual increase of the load, the deformation displacement of the longitudinal elastomer 30 will increase slowly. However, once the load is larger than the pre-compression load F1 of the small-stiffness elastic element 31, the small-stiffness elastic element 31 starts to bear the load. At this time, the longitudinal compression stiffness of the longitudinal elastomer 30 starts to become small, and the deformation displacement thereof will increase quickly to achieve the two-stage variable stiffness property being soft at first and then becoming hard of the longitudinal elastomer 30, and when the railway vehicle passes by a curve, it can be guaranteed that the lateral force between the wheel rails will not be too large to guarantee the curve operation safety of the vehicle.

Figure 7:
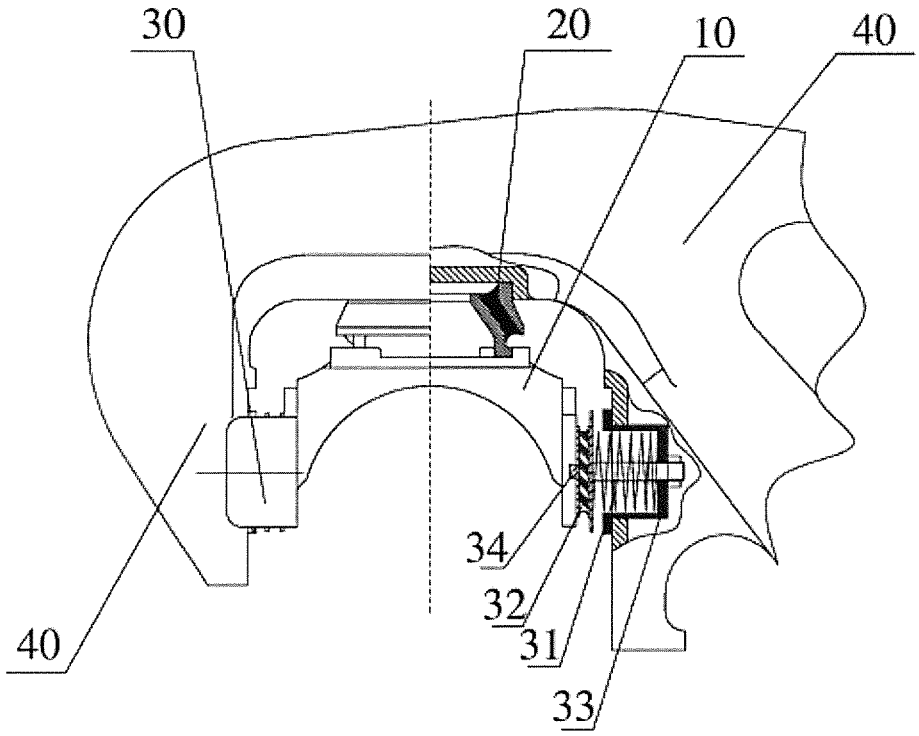
FIG. 7 is a schematic diagram of a main sectional structure of another variable stiffness positioning device for a railway vehicle bogie axle box.

As shown in FIG. 7, the overall structure of another variable stiffness positioning device for railway vehicle bogie axle box provided by the present invention is basically the same as that in embodiment 1, and the difference still lies in the fourth longitudinal elastomer 30 formed by the small-stiffness elastic element 31, the large-stiffness elastic element 32 and the elastomer pre-compression device 33.

Figure 8:
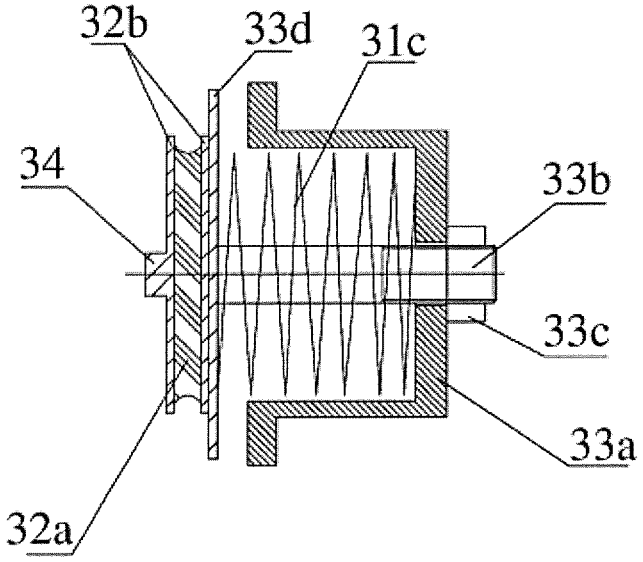
FIG. 8 is a schematic diagram of an amplified sectional structure of a fourth longitudinal elastomer in FIG. 7.

As shown in FIG. 8, in the fourth longitudinal elastomer 30, the large-stiffness elastic element 32 is provided with an elastic rubber base layer 32*a*, and the elastic rubber base layer 32*a* is clamped between two metal bearing plates 32*b* and is vulcanized into an entirety with the same.

The elastomer pre-compression device 33 is provided with a rigid outer cover 33*a*, an oriented positioning screw 33*b* is axially arranged in the rigid outer cover 33*a*, one end of the oriented positioning screw 33*b* stretches out from the opening of the rigid outer cover 33*a* to be fixedly connected with an end face baffle 33*d*, the other end of the oriented positioning screw 33*b* stretches out from the bottom surface of the rigid outer cover 33*a* to form threaded connection with a locking nut 33*c*, the end face baffle 33*d* is propped against one metal bearing plate 32*b*, and a positioning lug boss 34 is arranged on the end face of the other metal bearing plate 32*b*.

The small-stiffness elastic element 31 is provided with a metal helical spring 31*c*, the metal helical spring 31*c* is sleeved on the oriented positioning screw 33*b*, one end of the metal helical spring 31*c* is propped against the end face baffle 33*d*, the other end of the metal helical spring 31*c* is propped against the bottom surface of the rigid outer cover 33*a*, and the metal helical spring 31*c* is at a pre-compression state under the action of the pre-compression load F1, after the locking nut 33*c* is tightened.

Still as shown in FIG. 7, when the positioning device provided by the present invention is assembled, the mounting structure of the vertical elastomer 20 is the same as that in embodiment 1. For the fourth longitudinal elastomer 30, the rigid outer cover 33*a* of the elastomer pre-compression device 33 is detachably embedded into a side face mounting hole of the guide frame 40 of the side frame, and the positioning lug boss 34 on the end face of the other metal bearing plate 32*b* of the large-stiffness elastic element 32 is suspended in the side face mounting hole of the axle box bearing saddle 10 and is extrusion positioned by the metal helical spring 31*c* and the end face baffle 33*d*. The obtained effect is the same as that in embodiment 1.

The invention claimed is:

1. A variable stiffness positioning device for a railway vehicle bogie axle box, installed between an axle box bearing saddle of a vehicle bogie and a guide frame of a side frame of the vehicle bogie, wherein:

the variable stiffness positioning device comprises a vertical elastomer arranged between the top face of the axle box bearing saddle and the bottom surface of the guide frame of the side fame, as well as longitudinal elastomers respectively arranged between the axle box bearing saddle and the front and back side faces of the guide frame of the side fame;

the longitudinal elastomer is provided with at least one small-stiffness elastic element and a large-stiffness elastic element, the small-stiffness elastic element is arranged in an elastomer pre-compression device and is serially arranged with the large-stiffness elastic element under the action of a pre-compression load F1;

during an increasing working load F2, the longitudinal elastomer satisfies the following relationship: when F2 is smaller than F1, the large-stiffness elastic element is compressed to deform at first;

when F2 is equal to F1, the large-stiffness elastic element and the pre-compressed small-stiffness elastic element are at a critical state; until when F2 is larger than F1, the small-stiffness elastic element starts to be continuously compressed to deform, so that the longitudinal elastomer has a two-stage variable stiffness property being hard at first and then becoming soft at the load state.

2. The variable stiffness positioning device for the railway vehicle bogie axle box of claim 1, wherein:

the large-stiffness elastic element is provided with an elastic rubber base layer, and the elastic rubber base layer is clamped between two metal bearing plates and is vulcanized into an entirety with the same;

the elastomer pre-compression device is provided with a rigid outer cover, an oriented positioning screw is axially arranged in the rigid outer cover, one end of the oriented positioning screw stretches out from the opening of the rigid outer cover to be fixedly connected with one of the two metal bearing plates, and the other end of the oriented positioning screw stretches out from the bottom surface of the rigid outer cover to form threaded connection with a locking nut;

the small-stiffness elastic element is provided with a conical cylindrical rubber layer, the conical cylindrical rubber layer is arranged between the inner wall of the rigid outer cover and the oriented positioning screw and is vulcanized into an entirety with the same, and the conical cylindrical rubber layer is at a pre-compression state under the tightening function of the locking nut.

3. The variable stiffness positioning device for the railway vehicle bogie axle box of claim 2, wherein the rigid outer cover of the elastomer pre-compression device is detachably embedded into a side face mounting hole of the guide frame of the side frame, and the other metal bearing plate of the large-stiffness elastic element is propped or hanged on the side face of the axle box bearing saddle.

4. The variable stiffness positioning device for the railway vehicle bogie axle box of claim 1, wherein:

the large-stiffness elastic element is provided with an elastic rubber base layer, and the elastic rubber base layer is clamped between two metal bearing plates and is vulcanized into an entirety with the same;

the elastomer pre-compression device is provided with a rigid outer cover, an oriented positioning screw is axially arranged in the rigid outer cover, one end of the oriented positioning screw stretches out from the opening of the rigid outer cover to be fixedly connected with one of the two metal bearing plates, and the other end of the oriented positioning screw stretches out from the bottom surface of the rigid outer cover to form threaded connection with a locking nut;

the small-stiffness elastic element is provided with a cylindrical overlapped rubber layer integrally vulcanization molded by multiple layers of sheet metals and multiple layers of sheet rubber, which are arranged in a staggered manner, the cylindrical overlapped rubber layer is sleeved on the oriented positioning screw, one end of the cylindrical overlapped rubber layer is propped against one of the two metal bearing plates, the other end of the cylindrical overlapped rubber layer is propped against the bottom surface of the rigid outer cover and the cylindrical overlapped rubber layer is at a pre-compression state under the tightening function of the locking nut.

5. The variable stiffness positioning device for the railway vehicle bogie axle box of claim 1, wherein:

the large-stiffness elastic element is provided with an elastic rubber base layer, and the elastic rubber base layer is clamped between two metal bearing plates and is vulcanized into an entirety with the same;

the elastomer pre-compression device is provided with a rigid outer cover, an oriented positioning screw is axially arranged in the rigid outer cover, one end of the oriented positioning screw stretches out from the opening of the rigid outer cover to be fixedly connected with one of the two metal bearing plates, and the other end of the oriented positioning screw stretches out from the bottom surface of the rigid outer cover to form threaded connection with a locking nut;

the small-stiffness elastic element is provided with a metal helical spring, the metal helical spring is sleeved on the oriented positioning screw, one end of the metal helical spring is propped against one of the two metal bearing plates, the other end of the metal helical spring is propped against the bottom surface of the rigid outer cover, and the metal helical spring is at a pre-compression state under the tightening function of the locking nut.

6. The variable stiffness positioning device for the railway vehicle bogie axle box of claim 1, wherein:

the large-stiffness elastic element is provided with an elastic rubber base layer, and the elastic rubber base layer is clamped between two metal bearing plates and is vulcanized into an entirety with the same;

the elastomer pre-compression device is provided with a rigid outer cover, an oriented positioning screw is axially arranged in the rigid outer cover, one end of the oriented positioning screw stretches out from the opening of the rigid outer cover to be fixedly connected with an end face baffle, the other end of the oriented positioning screw stretches out from the bottom surface of the rigid outer cover to form threaded connection with a locking nut, the end face baffle is propped against one of the two metal bearing plates, and a positioning lug boss is arranged on the end face of the other metal bearing plate;

the small-stiffness elastic element is provided with a metal helical spring, the metal helical spring is sleeved on the oriented positioning screw, one end of the metal helical spring is propped against the end face baffle, the other end of the metal helical spring is propped against the bottom surface of the rigid outer cover, and the metal helical spring is at a pre-compression state under the tightening function of the locking nut.

7. The variable stiffness positioning device for the railway vehicle bogie axle box of claim 1, wherein the vertical elastomer comprises an inner metal supporting sleeve with a conical surface outer wall and an outer metal supporting sleeve with a conical surface inner wall, a trumpet-shaped rubber sleeve vulcanized into an entirety with the inner metal supporting sleeve and the outer metal supporting sleeve is arranged there between, so that the vertical elastomer is of a conical platform-shaped structure on the whole.

8. The variable stiffness positioning device for the railway vehicle bogie axle box of claim 7, wherein a cylindrical surface extension segment is smoothly arranged at the upper part of the conical surface inner wall of the outer metal supporting sleeve, the cylindrical surface extension segment is in vulcanization connection with the upper part of the outer wall of the trumpet-shaped rubber sleeve, and the upper and lower ends of the trumpet-shaped rubber sleeve are of concave curve surface structures.

9. The variable stiffness positioning device for the railway vehicle bogie axle box of claim 7, wherein the trumpet-shaped rubber sleeve is integrally vulcanization molded by multiple layers of trumpet-shaped metal rings and multiple layers of trumpet-shaped rubber rings which are arranged in a staggered manner, and the included angles $\alpha$ between the generatrixes of the trumpet-shaped metal rings and the trumpet-shaped rubber rings with the conical surface inner wall of the outer metal supporting sleeve are 15-88 degrees.

10. The variable stiffness positioning device for the railway vehicle bogie axle box of claim 7, wherein the upper end of the outer metal supporting sleeve is embedded into a bottom surface mounting hole of the guide frame of the side frame, and the lower end of the inner metal supporting sleeve is embedded into a top face mounting hole of the axle box bearing saddle.

* * * * *